US005640136A

United States Patent [19]

Yodogawa et al.

[11] Patent Number: 5,640,136

[45] Date of Patent: Jun. 17, 1997

[54] VOLTAGE-DEPENDENT NONLINEAR RESISTOR

[75] Inventors: Masatada Yodogawa, Tokyo; Toshiyuki Yamazaki, Chiba; Hitomi Naitou, Saitama; Masahito Furukawa, Chiba; Dai Matsuoka, Chiba, all of Japan

[73] Assignee: TDK Corporation, Tokyo, Japan

[21] Appl. No.: 244,380

[22] PCT Filed: Oct. 8, 1993

[86] PCT No.: PCT/JP93/01456

§ 371 Date: Jun. 9, 1994

§ 102(e) Date: Jun. 9, 1994

[87] PCT Pub. No.: WO94/09499

PCT Pub. Date: Apr. 28, 1994

[30] Foreign Application Priority Data

| | | | |
|---|---|---|---|
| Oct. 9, 1992 | [JP] | Japan | 4-297748 |
| Oct. 22, 1992 | [JP] | Japan | 4-308194 |
| Nov. 12, 1992 | [JP] | Japan | 4-327303 |
| Nov. 20, 1992 | [JP] | Japan | 4-335273 |
| Mar. 15, 1993 | [JP] | Japan | 5-080041 |

[51] Int. Cl.[6] ..... H01C 7/10

[52] U.S. Cl. ..... 338/20; 338/21; 252/521; 264/617

[58] Field of Search ..... 338/20, 21, 324; 427/80, 101, 102; 252/521; 264/61

[56] References Cited

U.S. PATENT DOCUMENTS

| | | | |
|---|---|---|---|
| 4,077,915 | 3/1978 | Yodogawa et al. . | |
| 4,160,748 | 7/1979 | Yodogawa et al. | 252/518 |
| 4,254,070 | 3/1981 | Yodogawa et al. . | |
| 4,290,041 | 9/1981 | Utsumi et al. | 338/21 |
| 4,319,215 | 3/1982 | Yamazaki et al. | 338/21 |
| 4,320,379 | 3/1982 | Yodogawa . | |
| 4,477,793 | 10/1984 | Mukae et al. | 338/21 |
| 5,107,242 | 4/1992 | Imai et al. | 338/21 |
| 5,225,111 | 7/1993 | Imai | 252/519 |

FOREIGN PATENT DOCUMENTS

| | | |
|---|---|---|
| 0351004 | 1/1990 | European Pat. Off. . |
| 4102756 | 8/1991 | Germany . |
| 59-106102 | 6/1984 | Japan . |
| 60-107802 | 6/1985 | Japan . |
| 61-40001 | 2/1986 | Japan . |
| 61-43403 | 3/1986 | Japan . |
| 61-50304 | 3/1986 | Japan . |

*Primary Examiner*—Tu B. Hoang

*Attorney, Agent, or Firm*—Oblon, Spivak, McClelland, Maier & Neustadt, P.C.

[57] ABSTRACT

The invention provides a voltage-dependent nonlinear resistor porcelain in the form of a ZnO system sintered body comprising zinc oxide as a major component and at least one of rare earth element oxides, cobalt oxide, chromium oxide, at least one of Group IIIb element oxides, at least one of Group Ia element oxides, 0.01 to 2 atom % calculated as Ca of calcium oxide, and 0.001 to 0.5 atom % calculated as Si of silicon oxide as subordinate components, the atomic ratio of calcium to silicon (Ca/Si) ranging from 0.2 to 20. With the atomic ratio of calcium to silicon (Ca/Si) set between 0.2 and 20, preferably between 2 and 6, the element has a significantly increased load life at high temperature and humidity. The element experiences less deterioration of the asymmetry of its volt-ampere characteristic between different directions of DC conduction. If magnesium oxide is added to the composition in an amount of 0.05 to 10 atom % calculated as Mg, the benefits are enhanced, with grain growth suppressed and leakage current minimized even on high temperature firing.

19 Claims, 1 Drawing Sheet

VOLTAGE-DEPENDENT NONLINEAR RESISTOR

TECHNICAL FIELD

This invention relates to voltage-dependent nonlinear resistors.

BACKGROUND OF THE INVENTION

In accordance with the rapid advance of semiconductor elements and semiconductor circuits such as thyristors, transistors and integrated circuits and their applications, the use of semiconductor elements and semiconductor circuits in instrumentation, control and communication equipment and power equipment is now widespread, and these equipment make rapid progress toward miniaturization and higher performance. On the other hand, despite such advances, these equipment and parts used therein are not regarded satisfactory in withstand voltage, surge rating and noise immunity. It is then a very important task to protect such equipment and parts from abnormal surge and noise or to establish a stable circuit voltage. For solving these problems, there is a demand for the development of a voltage-dependent nonlinear resistor material which has substantial voltage-dependent nonlinearity, great discharge withstand current rating, and improved life property and is inexpensive.

Used for such purposes are varistors containing silicon carbide (SIC), selenium (Se), silicon (Si), ZnO or the like as a major component. Among others, the varistors based on ZnO are generally characterized by a low clamping voltage and a great voltage-dependent nonlinearity index. These varistors are then suitable for protection again overvoltage of equipment composed of elements having a low overcurrent rating such as semiconductor elements and have been widely utilized as a substitute for SiC-based varistors.

By the way, such ZnO-based voltage-dependent nonlinear resistors are generally prepared, like voltage-dependent nonlinear resistors based on other materials, by firing a compact of a voltage-dependent nonlinear resistor-forming source powder containing ZnO as a major component according to a firing process including a heating step, a high temperature holding step and a cooling step. In the prior art, the entire firing process was carried out in an atmosphere having a constant oxygen partial pressure (typically ambient air), but no varistors thus obtained had a nonlinearity index $\alpha$ in excess of 100, with $\alpha$ being normally about 50.

JP-A 106102/1984 proposes a method for preparing a ZnO-based varistor wherein the oxygen partial pressure of the firing atmosphere used in the firing process is switched from below to above $2\times10^{-1}$ atm (air's oxygen partial pressure) in a time region from a point in a later stage of the high-temperature holding step to a point immediately after transition to the cooling step, for the purpose of providing an increased $\alpha$ value.

DISCLOSURE OF THE INVENTION

However, the prior art ZnO-based varistors are likely to degrade in a load life test at high temperature and humidity and must be provided with glass coatings or the like. A problem also arises with respect to degradation by DC voltage application that the volt-ampere characteristic becomes asymmetric depending on the direction of voltage application. The prior art ZnO-based varistors have another problem that grain growth is accelerated and leakage current is increased particularly when they are manufactured under high-temperature firing conditions.

Further, in the prior art manufacturing technology, no research work has been made on the relationship of varistor properties except for $\alpha$ to the oxygen partial pressure of the firing atmosphere. When varistors were actually manufactured by the method of the above-referred JP-A 106102/1984, there occurred a surge life problem as shown by a change rate of varistor voltage approaching to −4.0% or more.

Disk varistors having a thickness in excess of about 2 mm suffer from the problem of a deteriorated surge life whichever technique is selected for firing among conventional ones. This is because in thicker varistors, grains have a smaller diameter in the interior than at the surface so that when current flow is conducted, most of the current flows solely along the surface to cause failure.

Therefore, a first object of the present invention is to provide a voltage-dependent nonlinear resistor which has an improved load life at high temperature and humidity and prevents degradation of the asymmetry of a volt-ampere characteristic between the directions of DC conduction.

Also a second object of the present invention is to provide a ceramic composition for a voltage-dependent nonlinear resistor which has an improved load life at high temperature and humidity, prevents degradation of the asymmetry of a volt-ampere characteristic between the directions of DC conduction, and can reduce leakage current.

Further a third object of the present invention is to provide a method for preparing a voltage-dependent nonlinear resistor so as to improve surge life property.

These and other objects are achieved by the present invention which is defined below as (1) to (26).

(1) A voltage-dependent nonlinear resistor in the form of a sintered body comprising zinc oxide as a major component and at least one of rare earth elements, cobalt oxide, chromium oxide, at least one of Group IIIb element oxides, at least one of Group Ia element oxides, 0.01 to 2 atom % calculated as Ca of calcium oxide, and 0.001 to 0.5 atom % calculated as Si of silicon oxide as subordinate components, the atom % being based on the total amount of metal or metalloid elements, the atomic ratio of calcium to silicon (Ca/Si) ranging from 0.2 to 20.

(2) The voltage-dependent nonlinear resistor of (1) wherein said rare earth elements include La, Pr, Nd, Sm, Eu, Gd, Tb, Dy, Ho, Er, Tm, Yb, and Lu.

(3) The voltage-dependent nonlinear resistor of (1) or (2) wherein said Group IIIb elements include B, Al, Ga, and In.

(4) The voltage-dependent nonlinear resistor of any one of (1) to (3) wherein said Group Ia elements include K, Rb, and Cs.

(5) The voltage-dependent nonlinear resistor of any one of (1) to (4) wherein said atomic ratio of calcium to silicon ranges from 2 to 6.

(6) The voltage-dependent nonlinear resistor of any one of (1) to (5) wherein said at least one of rare earth elements is present in an amount of 0.05 to 5 atom % based on the total amount of metal or metalloid elements.

(7) The voltage-dependent nonlinear resistor of any one of (1) to (6) wherein cobalt is present in an amount of 0.1 to 20 atom % based on the total amount of metal or metalloid elements.

(8) The voltage-dependent nonlinear resistor of any one of (1) to (7) wherein chromium is present in an amount of 0.01 to 1 atom % based on the total amount of metal or metalloid elements.

(9) The voltage-dependent nonlinear resistor of any one of (1) to (8) wherein said at least one of Group IIIb elements is present in a total amount of 0.0005 to 0.5 atom % based on the total amount of metal or metalloid elements.

(10) The voltage-dependent nonlinear resistor of any one of (1) to (9) wherein said at least one of Group Ia elements is present in a total amount of 0.001 to 1 atom % based on the total amount of metal or metalloid elements.

(11) The voltage-dependent nonlinear resistor of any one of (1) to (10) which further contains magnesium oxide.

(12) The voltage-dependent nonlinear resistor of (11) wherein magnesium is present in an amount of 0.05 to 10 atom % based on the total amount of metal or metalloid elements.

(13) The voltage-dependent nonlinear resistor of any one of (1) to (12) which is prepared by firing a compact of a voltage-dependent nonlinear resistor-forming source powder containing ZnO as a major component according to a firing process including a heating/temperature rise step, a high temperature holding step, and a cooling step, wherein the firing atmosphere has an oxygen partial pressure which is kept below $1.5\times10^{-1}$ atm for at least a portion of the heating/temperature rise step and thereafter increased above $1.5\times10^{-1}$ atm.

(14) The voltage-dependent nonlinear resistor of (13) wherein the oxygen partial pressure of the firing atmosphere is switched from below to above $1.5\times10^{-1}$ atm in said heating/temperature rise step while the temperature is 600° C. to 1,300° C.

(15) The voltage-dependent nonlinear resistor of (14) wherein the oxygen partial pressure of the firing atmosphere is switched from below to above $1.5\times10^{-1}$ atm in said heating/temperature rise step while the temperature is 800° C. to 1,200° C.

(16) The voltage-dependent nonlinear resistor of any one of (1) to (12) which is prepared by firing a compact of a voltage-dependent nonlinear resistor-forming source powder containing ZnO as a major component according to a firing process including a heating/temperature rise step, a high temperature holding step, and a cooling step, wherein said heating/temperature rise step includes a temperature holding step inserted midway thereof, and the firing atmosphere has an oxygen partial pressure which is kept below $1.5\times10^{-1}$ atm for at least said temperature holding step and thereafter increased above $1.5\times10^{-1}$ atm.

(17) The voltage-dependent nonlinear resistor of (16) wherein said temperature holding step is inserted in the temperature range of 600° C. to 1,250° C.

(18) The voltage-dependent nonlinear resistor of any one of (1) to (12) which is prepared by firing a compact of a voltage-dependent nonlinear resistor-forming source powder containing ZnO as a major component according to a firing process including a heating/temperature rise step, a high temperature holding step, and a cooling step, wherein a protreatment process including a heating/temperature rise step, a temperature holding step of holding at a treating temperature below the firing temperature, and a cooling step wherein the treating atmosphere has an oxygen partial pressure set below $1.5\times10^{-1}$ atm is provided prior to said firing process, and the oxygen partial pressure of the firing atmosphere is increased above $1.5\times10^{-1}$ atm in said firing process.

(19) The voltage-dependent nonlinear resistor of (18) wherein said temperature holding step is inserted in the temperature range of 600° C. to 1,250° C.

(20) A method for preparing a voltage-dependent nonlinear resistor by firing a compact of a voltage-dependent nonlinear resistor-forming source powder containing ZnO as a major component according to a firing process including a heating/temperature rise step, a high temperature holding step, and a cooling step, wherein the firing atmosphere has an oxygen partial pressure which is kept below $1.5\times10^{-1}$ atm for at least a portion of the heating/temperature rise step and thereafter increased above $1.5\times10^{-1}$ atm.

(21) The method for preparing a voltage-dependent nonlinear resistor of (20) wherein the oxygen partial pressure of the firing atmosphere is switched from below to above $1.5\times10^{-1}$ atm in said heating/temperature rise step while the temperature is 600° C. to 1,300° C.

(22) The method for preparing a voltage-dependent nonlinear resistor of (21) wherein the oxygen partial pressure of the firing atmosphere is switched from below to above $1.5\times10^{-1}$ atm in said heating/temperature rise step while the temperature is 800° C. to 1,200° C.

(23) A method for preparing a voltage-dependent nonlinear resistor by firing a compact of a voltage-dependent nonlinear resistor-forming source powder containing ZnO as a major component according to a firing process including a heating/temperature rise step, a high temperature holding step, and a cooling step, wherein said heating/temperature rise step includes a temperature holding step inserted midway thereof, and the firing atmosphere has an oxygen partial pressure which is kept below $1.5\times10^{-1}$ atm for at least said temperature holding step and above $1.5\times10^{-1}$ atm in the remaining time regions.

(24) The method for preparing a voltage-dependent nonlinear resistor of (23) wherein said temperature holding step is inserted in the temperature range of 600° C. to 1,250° C.

(25) A method for preparing a voltage-dependent nonlinear resistor by firing a compact of a voltage-dependent nonlinear resistor-forming source powder containing ZnO as a major component according to a firing process including a heating/temperature rise step, a high temperature holding step and a cooling step, wherein a pretreatment process including a heating/temperature rise step, a temperature holding step of holding at a treating temperature lower than the firing temperature, and a cooling step wherein the treating atmosphere has an oxygen partial pressure set below $1.5\times10^{-1}$ atm is provided prior to said firing process, and the oxygen partial pressure of the firing atmosphere is increased above $1.5\times10^{-1}$ atm in said firing process.

(26) The method for preparing a voltage-dependent nonlinear resistor of (25) wherein said temperature holding step is inserted in the temperature range of 600° C. to 1,250° C.

OPERATION AND ADVANTAGES OF THE INVENTION

The voltage-dependent nonlinear resistor of the present invention, in which the atomic ratio of calcium to silicon added (Ca/Si) is set in the range between 0.2 and 20, preferably between 2 and 6, is improved in load life at high temperature and humidity and prevents degradation of the asymmetry of a volt-ampere characteristic between the directions of DC conduction as much as possible.

Further, in the voltage-dependent nonlinear resistor, in which Mg is added in an amount of 0.05 to 10.0 atom % calculated in percent solely as a metal element, grain growth is suppressed and leakage current is reduced even on firing at high temperature.

In the method for preparing a voltage-dependent nonlinear resistor according to the present invention, firing at an oxygen partial pressure of less than $1.5\times10^{-1}$ atm in a stage prior to final firing accelerates formation of uniform ZnO grains inside and outside the ceramic body and conversion of ZnO grains into semiconductor, and subsequent firing at an oxygen partial pressure of $1.5\times10^{-1}$ atm or higher promotes oxidation of ZnO grains at their grain boundary and uniform grain growth, resulting in varistors having uniform properties. The full conversion of ZnO grains into semiconductor leads to excellent surge life property.

BEST MODE FOR CARRYING OUT THE INVENTION

Figure 1:
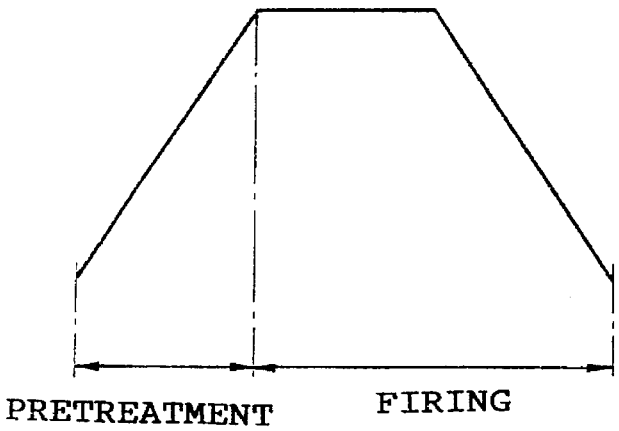
FIG. 1 is a time chart illustrating one exemplary firing temperature profile according to the present invention.

The voltage-dependent nonlinear resistor of the invention contains zinc oxide as a major component. The content of zinc oxide is preferably at least 80 atom %, especially 85 to 99 atom %, calculated as Zn, based on the metal or metalloid elements.

There are contained at least one of rare earth element oxides; cobalt oxide; chromium oxide; at least one of Group IIIb element oxides; at least one of Group Ia element oxides; calcium oxide; and silicon oxide as subordinate components.

Among the metal elements constituting the subordinate components, the rare earth elements include Y and lanthanides, with one or more of La, Pt, Nd, Sm, Eu, Gd, Tb, Dy, Ho, Er, Tm, Yb, and Lu being preferred. Where two or more elements are used, they may be mixed at any ratio. The rare earth element content is preferably such that the total amount of one or more rare earth elements is 0.05 to 5 atom % calculated in atomic percent based solely on the metals and metalloids. The content of cobalt is preferably 0.1 to 20 atom %. The content of chromium is preferably 0.01 to 1 atom %. Preferred among the Group IIIb elements is at least one of boron, aluminum, gallium, and indium and where two or more elements are used, they may be mixed at any ratio as long as their total amount is preferably 0.0005 to 0.5 atom %. Preferred among the Group Ia elements is at least one of potassium, rubidium, and cesium and where two or more elements are used, they may be mixed at any ratio as long as their total amount is preferably 0.001 to 1 atom %. The content of calcium is preferably 0.01 to 2 atom %. The content of silicon is preferably 0.001 to 0.5 atom %.

With this proviso, the atomic ratio of calcium to silicon (Ca/Si) should be set in the range from 0.2 to 20, especially from 2 to 6.

The above-mentioned quantitative limitation is preferable for the following reason. If the Zn amount decreases, degradation would be likely to occur in a load life test at high temperature and humidity. The rare earth elements are effective for improving voltage-dependent nonlinear resistor characteristic, but in excessive amounts, they would lower a surge rating. Co is effective for improving voltage-dependent nonlinear resistor characteristic, but in excessive amounts, it would lower clamping voltage property. Cr is effective for improving voltage-dependent nonlinear resistor characteristic, but in excessive amounts, it would lower an energy rating. The Group IIIb elements are effective for improving clamping voltage property and an energy rating, but in excessive amounts, they would lower voltage-dependent nonlinear resistor characteristic. The Group Ia elements are effective for improving leakage current characteristic, but in excessive amounts, they would lower an energy rating. Ca is effective for improving voltage-dependent nonlinear resistor characteristic, but in excessive amounts, it would lower an energy rating. Si is effective for improving leakage current characteristic, but in excessive amounts, it would hinder sintering. If the Ca/Si ratio is less than 0.2 or more than 20, then the asymmetry of initial volt-ampere characteristic is exacerbated, its degradation is enhanced, and the non-linearity is reduced. Also with a Ca/Si ratio of less than 0.2, the load life is exacerbated.

Further preferably, magnesium oxide is contained as the subordinate component. The content of Mg is preferably 0.05 to 10 atom %. Addition of Mg is effective for preventing degradation of the asymmetry of a volt-ampere characteristic and reducing leakage current.

The varistor element of the above-mentioned composition is in the form of a sintered body having grains of about 1 to 100 μm in size. The grains contain cobalt, aluminum and other subordinate components along with the major component ZnO, with the remaining subordinate components being present along the grain boundary.

The sintered body is then processed in a conventional manner as by connecting electrodes thereto, completing a voltage-dependent nonlinear resistor. In general, no coating of glass or the like is necessary. The element finds use as any voltage-dependent nonlinear resistor in home electric appliances, industrial equipment and the like, especially as large sized elements in high-voltage industrial equipment and the like.

Next, the method for preparing such elements is described. Firing may be done in a conventional manner although it is preferred to take pretreatment and firing processes, for example, as shown in the time charts of FIGS. 1 to 3, which will be described below.

In the pretreatment process, the atmosphere has an oxygen partial pressure which is kept below $1.5\times10^{-1}$ atm which corresponds to the oxygen partial pressure of ambient air. (This oxygen partial pressure in the pretreatment process is sometimes referred to as a first oxygen partial pressure in the present specification.) In particular, this oxygen partial pressure is desirably up to $1\times10^{-1}$ atm, especially up to $5\times10^{-2}$ atm. It is understood that the oxygen partial pressure is generally at least about $10^{-5}$ atm. This is because heat treatment under an oxygen partial pressure within the above-defined range is required in order to provide uniform grain growth in the interior and at the surface of a ceramic body. Such an oxygen partial pressure is accomplished by evacuating the system or using such gases as nitrogen and argon. It is to be noted that control of the first and second oxygen partial pressures may be done when the temperature is at least about 400° C.

In the firing process, the oxygen partial pressure is kept at $1.5\times10^{-1}$ atm or higher, especially $2\times10^{-1}$ atm or higher and it is generally lower than about 10 atm. (This oxygen partial pressure is sometimes referred to as a second oxygen partial pressure in the present specification.) This is because an oxygen partial pressure corresponding to approximately the ambient air or higher is necessary to oxidize again the ceramic body which has been reduced by the heat treatment under the first oxygen partial pressure. The pressure used herein may be approximately the atmospheric pressure.

The embodiment shown in FIG. 1 carries out a series of steps including a heating/temperature rising step, a temperature holding step, and a cooling step. The temperature of the temperature holding step is generally set in the range of 1,150° to 1,450° C., especially 1,250° to 1,450° C. though it varies with a particular material. The temperature rise rate is set at about 5° to 1,000° C./hour, especially about 200° C./hour. Further the cooling rate is about 5° to 1,000° C./hour. In this embodiment, at least a portion of the heating/temperature rising step uses the above-mentioned first oxygen partial pressure and the remaining time regions have the oxygen partial pressure switched to the above-mentioned second oxygen partial pressure. More particularly, the first oxygen partial pressure is kept at the longest in a time region from a temperature between room temperature and 400° C. to a time of ⅓, especially 1/10 of the holding time after the start of the temperature holding step. A switch of the oxygen partial pressure is effected at a temperature of 600° to 1,300° C., especially 800° to 1,200° C.

Figure 2:
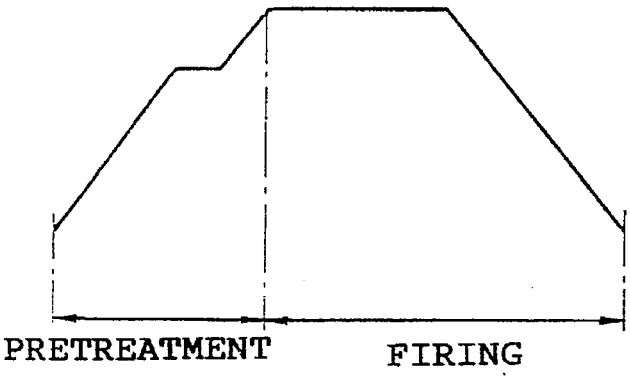
FIG. 2 is a time chart illustrating another exemplary firing temperature profile according to the present invention.

The embodiment shown in FIG. 2 carries out a series of steps including a heating/temperature rising step, a pretreatment temperature holding step, a heating/temperature rising step, a temperature holding step, and a cooling step. The holding temperature of the pretreatment temperature holding step is desirably in the range of 600° to 1,250° C., especially 600° to 1,200° C., furthermore 900° to 1,200° C. This is because the compact undergoes drastic shrinkage and sintering within that temperature range. The temperature of the temperature holding step and the temperature rise and drop rates are the same as in the embodiment of FIG. 1. In this embodiment, among the two heating/temperature rising steps and pretreatment temperature holding step, the first oxygen partial pressure is kept until at least the pretreatment temperature holding step, and the second oxygen partial pressure is kept in the remaining time regions. More particularly, the first oxygen partial pressure is kept at the shortest during the pretreatment temperature holding step and at the longest from a temperature between room temperature and 400° C. to a time of ⅓, especially 1/10 of the holding time after the start of the temperature holding step. The switch temperature is the same as in the embodiment of FIG. 1.

Figure 3:
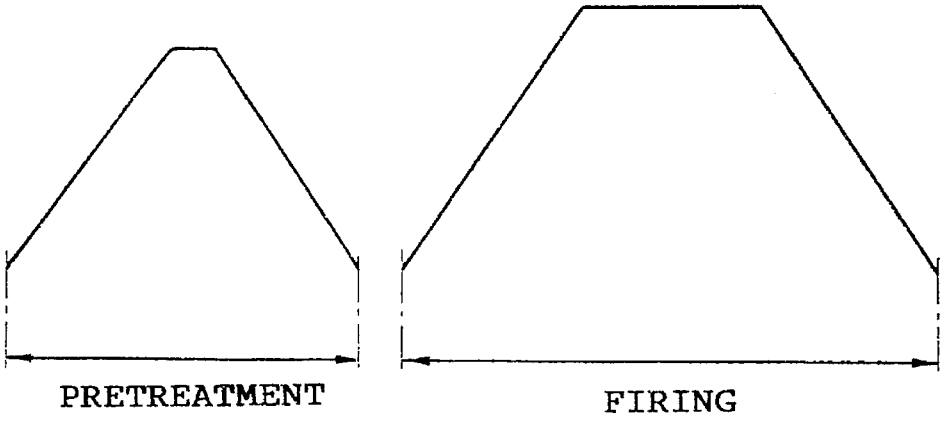
FIG. 3 is a time chart illustrating a further exemplary firing temperature profile according to the present invention.

The embodiment shown in FIG. 3 carries out a pretreatment process comprising a series of steps including a heating/temperature rising step, a temperature holding step, and a cooling step and a firing process comprising a series of steps including a heating/temperature rising step, a temperature holding step, and a cooling step. The holding temperature of the temperature holding step in the firing process, the temperature rise and drop rates in the pretreatment and firing processes and the like are the same as in the embodiment of FIG. 1. Also the holding temperature of the temperature holding step in the pretreatment process may be equal to the temperature of the pretreatment temperature holding step in FIG. 2. The reasons are the same as in the embodiment of FIG. 2.

In all the above-mentioned embodiments, the holding time of the temperature holding step in the firing process is desirably at least 30 minutes. Also, the holding times of the pretreatment temperature holding step and the temperature holding step in the pretreatment process in the embodiments of FIGS. 2 and 3, respectively, are desirably up to 6 hours. Within such a length of time, uniform growth and sufficient conversion to semiconductor of ZnO grains can be achieved inside and outside the ceramic body.

It is to be noted that the source materials used herein include oxides such as ZnO and compounds which convert into oxides upon firing, for example, carbonates and oxalates. The source material of ZnO having a particle size of about 0.1 to about 5 μm and the source materials of subordinate components having a particle size of about 0.1 to about 3 μm may be used or the source materials may be added in solution form. Mixing and compacting steps are conventional.

The above-mentioned preparation method is adequate in preparing ZnO-based voltage-dependent nonlinear resistors containing at least 80 atom %, preferably 85 to 99 atom % of Zn based on the metal or metalloid elements. There can be contained rare earth elements, cobalt, chromium, Group IIIb elements, Group Ia elements, calcium and silicon as the subordinate components.

EXAMPLE

Examples of the present invention are given below by way of illustration.

EXAMPLE 1

To ZnO powder were added and mixed $Pt_6O_{11}$, $Co_3O_4$, $CaCO_3$, $SiO_2$, and other additives in amounts corresponding to the atom percents (calculated in percent based on the metal or metalloid elements) shown in Table 1, and the mixtures were granulated with the aid of a binder. In sample Nos. 1 to 7, the amount of silicon (Si) was changed relative to a fixed amount of calcium (Ca). Inversely, in sample Nos. 8 to 14, the amount of Ca was changed relative to a fixed amount of Si. Further in sample Nos. 15 to 18, the amounts of Ca and Si were changed with the Ca/Si ratio fixed at 5.

TABLE 1

| Sample | Additive components (atom %) | | | | | | | | Ca/Si | $V_{1mA}$ | | $\Delta V_{1mA}$ | $\Delta V_{1mA}$ |
|---|---|---|---|---|---|---|---|---|---|---|---|---|---|
| No. | Zn | Pr | Co | Al | K | Cr | Ca | Si | ratio | (V) | α | Forward (%) | Reverse (%) |
| 1 | 96.945 | 0.5 | 1.5 | 0.005 | 0.05 | 0.1 | 0.1 | 0.8 | 0.125 | 113 | 32 | −18.8 | −23.1 |
| 2 | 97.245 | 0.5 | 1.5 | 0.005 | 0.05 | 0.1 | 0.1 | 0.5 | 0.2 | 109 | 36 | −0.7 | −0.9 |
| 3 | 97.695 | 0.5 | 1.5 | 0.005 | 0.05 | 0.1 | 0.1 | 0.05 | 2 | 103 | 41 | −0.4 | −0.6 |
| 4 | 97.725 | 0.5 | 1.5 | 0.005 | 0.05 | 0.1 | 0.1 | 0.02 | 5 | 102 | 61 | −0.2 | −0.2 |
| 5 | 97.735 | 0.5 | 1.5 | 0.005 | 0.05 | 0.1 | 0.1 | 0.01 | 10 | 100 | 37 | −1.3 | −1.7 |
| 6 | 97.74 | 0.5 | 1.5 | 0.005 | 0.05 | 0.1 | 0.1 | 0.005 | 20 | 97 | 41 | −3.0 | −3.2 |
| 7 | 97.744 | 0.5 | 1.5 | 0.005 | 0.05 | 0.1 | 0.1 | 0.0008 | 125 | 95 | 23 | −24.4 | −40.9 |
| 8 | 97.787 | 0.5 | 1.5 | 0.005 | 0.05 | 0.1 | 0.008 | 0.05 | 0.16 | 91 | 23 | −14.4 | −21.5 |
| 9 | 97.745 | 0.5 | 1.5 | 0.005 | 0.05 | 0.1 | 0.05 | 0.05 | 1 | 99 | 31 | −1.0 | −1.3 |
| 10 | 97.695 | 0.5 | 1.5 | 0.005 | 0.05 | 0.1 | 0.1 | 0.05 | 2 | 103 | 41 | −0.6 | −0.8 |
| 11 | 97.595 | 0.5 | 1.5 | 0.005 | 0.05 | 0.1 | 0.2 | 0.05 | 4 | 104 | 58 | −0.5 | −0.3 |
| 12 | 96.995 | 0.5 | 1.5 | 0.005 | 0.05 | 0.1 | 0.8 | 0.05 | 16 | 105 | 43 | −2.3 | −3.1 |
| 13 | 96.795 | 0.5 | 1.5 | 0.005 | 0.05 | 0.1 | 1 | 0.05 | 20 | 107 | 40 | −3.9 | −4.0 |

TABLE 1-continued

| Sample | Additive components (atom %) | | | | | | | | Ca/Si | $V_{1mA}$ | | $\Delta V_{1mA}$ | $\Delta V_{1mA}$ |
|---|---|---|---|---|---|---|---|---|---|---|---|---|---|
| No. | Zn | Pr | Co | Al | K | Cr | Ca | Si | ratio | (V) | α | Forward (%) | Reverse (%) |
| 14 | 94.795 | 0.5 | 1.5 | 0.005 | 0.05 | 0.1 | 3 | 0.05 | 60 | 110 | 31 | −12.9 | −28.8 |
| 15 | 97.841 | 0.5 | 1.5 | 0.005 | 0.05 | 0.1 | 0.003 | 0.0006 | 5 | 89 | 16 | −14.6 | −18 |
| 16 | 97.809 | 0.5 | 1.5 | 0.005 | 0.05 | 0.1 | 0.03 | 0.006 | 5 | 97 | 39 | −0.4 | −0.5 |
| 17 | 97.725 | 0.5 | 1.5 | 0.005 | 0.05 | 0.1 | 0.1 | 0.02 | 5 | 102 | 61 | −0.2 | 0.2 |
| 18 | 94.245 | 0.5 | 1.5 | 0.005 | 0.05 | 0.1 | 3 | 0.6 | 5 | 115 | 38 | −23.4 | −31.7 |

The mixtures were pressure molded into disks of 17 mm in diameter and fired at 1,200° to 1,400° C. for several hours into sintered disks. Electrodes were baked to both the surfaces of the sintered disks to complete voltage-dependent nonlinear resistors or sample Nos. 1 to 18, which were measured for electrical properties.

The electrical property measured was a nonlinearity index α between 1 mA and 10 mA and the load life property at high temperature and humidity measured was a change rate of the electrode voltage ($V_{1mA}$) developed when a current flow of 1 mA was conducted after a voltage corresponding to 90% of the varistor voltage was applied for 100 hours in an atmosphere of temperature 85° C. and humidity 85%.

Provided that the current in the same direction as the positive to negative electrode upon voltage application is forward and the current in the opposite direction is reverse, the change rate was measured in both the directions to examine the symmetry of degradation.

The results are shown in the foregoing Table 1. It is to be noted that the nonlinearity index α is represented by the following equation:

$$\alpha=\log(10/1)/\log(V_{10mA}/V_{1mA})$$

wherein $V_{10mA}$ and $V_{1mA}$ denote varistor voltages at 10 mA and 1 mA, respectively.

It is seen from Table 1 that in sample Nos. 2 to 6 wherein Ca/Si is between 0.2 and 20, the change rate of $V_{1mA}$ is as small as 3 or less upon forward current conduction and little difference found between the change rates upon forward and reverse current conduction indicates good symmetry.

However, in sample Nos. 1 and 7, the change rate of $V_{1mA}$ is as large as 18.8 and 24.4, indicating a short life, and the difference between the change rates is as large as 4.3 and 16.5, indicating low symmetry.

Also, when the amount of Ca is varied, sample Nos. 8 and 14 wherein Ca/Si is outside the range between 0.2 and 20 show a higher change rate and a larger difference between forward and reverse change rates as compared with sample Nos. 9 to 13 wherein Ca/Si is inside the range, indicating asymmetric degradation.

Further, it is seen that even with the value of Ca/Si set optimum 5 among sample Nos. 1 to 13, if the amount of Ca added is less than 0.01 atom % or more than 2 atom % or if the amount of Si added is less than 0.001 atom % or more than 0.5 atom %, that is, for a given value of Ca/Si in the preferred range, if the amount of Ca or Si added is too large or too small, initial properties and reliability are adversely affected.

Next, with the Ca/Si ratio set at the preferred value of 3.33, sample Nos. 20 to 31 were prepared by the same procedure as above by adding rare earth elements other than praseodymium Pt, that is, lanthanum La, neodymium Nd, samarium Sm, europium Eu, gadolinium Gd, terbium Tb, dysprosium Dy, holmium Ho, erbium Er, thulium Tm, ytterbium Yb, and lutetium Lu and other additives to ZnO powder as shown in Table 2. These samples, Nos. 20 to 31, were also measured for electrical properties under the same conditions as above. The results are also shown in Table 2.

TABLE 2

| Sample | Additive components (atom %) | | | | | | | | Ca/Si | $V_{1mA}$ | Nonlinear | $\Delta V_{1mA}$ | $\Delta V_{1mA}$ |
|---|---|---|---|---|---|---|---|---|---|---|---|---|---|
| No. | Rare Earth | | Co | Al | K | Cr | Ca | Si | ratio | (V) | index α | Forward (%) | Reverse (%) |
| 20 | La | 0.5 | 1.8 | 0.005 | 0.1 | 0.1 | 0.1 | 0.03 | 3.33 | 75 | 39 | −1.8 | −2 |
| 21 | Nd | 1 | 1.8 | 0.005 | 0.1 | 0.1 | 0.2 | 0.06 | 3.33 | 101 | 49 | −0.5 | −0.6 |
| 22 | Sm | 1 | 1.8 | 0.005 | 0.1 | 0.1 | 0.2 | 0.06 | 3.33 | 103 | 41 | −0.9 | −0.9 |
| 24 | Eu | 1 | 1.8 | 0.005 | 0.1 | 0.1 | 0.2 | 0.06 | 3.33 | 106 | 43 | −0.8 | −0.7 |
| 23 | Gd | 1 | 1.8 | 0.005 | 0.1 | 0.1 | 0.2 | 0.06 | 3.33 | 107 | 39 | −1.2 | −1.4 |
| 25 | Tb | 1 | 1.8 | 0.005 | 0.1 | 0.1 | 0.2 | 0.06 | 3.33 | 105 | 45 | −1.5 | −1.7 |
| 26 | Dy | 1 | 1.8 | 0.005 | 0.2 | 0.1 | 0.5 | 0.15 | 3.33 | 105 | 42 | −0.9 | −1.1 |
| 27 | Ho | 1 | 1.8 | 0.005 | 0.2 | 0.1 | 0.5 | 0.15 | 3.33 | 119 | 40 | −0.8 | −0.9 |
| 28 | Er | 1 | 1.8 | 0.005 | 0.2 | 0.1 | 0.5 | 0.15 | 3.33 | 122 | 38 | −0.9 | −1.2 |
| 29 | Tm | 1 | 1.8 | 0.005 | 0.2 | 0.1 | 0.5 | 0.15 | 3.33 | 126 | 39 | −1.1 | −1 |
| 30 | Yb | 1 | 1.8 | 0.005 | 0.2 | 0.1 | 0.5 | 0.15 | 3.33 | 131 | 41 | −1.3 | −1.4 |
| 31 | Lu | 1 | 1.8 | 0.005 | 0.2 | 0.1 | 0.5 | 0.15 | 3.33 | 148 | 37 | −1.9 | −2.1 |

As seen from Table 2, the addition of rare earth elements other than Pr gave satisfactory results in the high temperature/high humidity load test like the addition of Pr. Similar tests Were done with rare earth elements other than the above-mentioned ones, obtaining equivalent results.

Next, with the Ca/Si ratio set at the preferred value of 4 or 5, sample Nos. 32 to 37 were prepared by the same procedure as above by adding two or more elements of praseodymium Pr, lanthanum La, gadolinium Gd, holmium Ho, and samarium Sm and other additives to ZnO powder as shown in Table 3. These samples, Nos. 32 to 37, were also measured for electrical properties under the same conditions as above. The results are also shown in Table 3.

TABLE 3

| Sample No. | Additive components (atom %) Rare earth | | Co | Al | K | Cr | Ca | Si | Ca/Si ratio | $V_{1mA}$ (V) | Nonlinear index α | Δ $V_{1mA}$ Forward (%) | Δ $V_{1mA}$ Reverse (%) |
|---|---|---|---|---|---|---|---|---|---|---|---|---|---|
| 32 | Pr + La | 0.2 | 1.3 | 0.005 | 0.05 | 0.1 | 0.1 | 0.02 | 5 | 98 | 59 | −0.7 | −1 |
| 33 | Pr + Gd | 0.2 | 1.3 | 0.005 | 0.05 | 0.1 | 0.1 | 0.02 | 5 | 109 | 40 | −1.4 | −1.1 |
| 34 | Pr + Ho | 0.2 | 1.3 | 0.005 | 0.05 | 0.1 | 0.1 | 0.02 | 5 | 112 | 45 | −0.9 | −1.2 |
| 35 | Pr + La + Gd | 0.3 | 1.3 | 0.005 | 0.05 | 0.1 | 0.2 | 0.05 | 4 | 110 | 42 | −0.5 | −0.5 |
| 36 | Pr + La + Ho | 0.3 | 1.3 | 0.005 | 0.05 | 0.1 | 0.2 | 0.05 | 4 | 115 | 40 | −1.1 | −1.4 |
| 37 | La + Gd + Sm | 0.3 | 1.3 | 0.005 | 0.05 | 0.1 | 0.2 | 0.05 | 4 | 107 | 43 | −1.5 | −1.8 |

As seen from Table 3, the addition of two or more rare earth elements gave satisfactory results in the high temperature/high humidity load test like the addition of a single rare earth element. Similar tests were done with combinations of rare earth elements other than the above-mentioned ones, obtaining equivalent results.

It is then evident that the voltage-dependent nonlinear resistors of the invention are improved in electrical properties such as high temperature/high humidity load since Ca/Si is set as defined herein.

Tables 4 to 6 show examples wherein various additives and their addition amounts were varied with the Ca/Si ratio fixed. The effectiveness of the invention is evident from these results.

TABLE 4

| Sample No. | Additive components (atom %) Zn | Pr | Co | Al | K | Cr | Ca | Si | Ca/Si ratio | $V_{1mA}$ (V) | α | Δ $V_{1mA}$ Forward (%) | Δ $V_{1mA}$ Reverse (%) |
|---|---|---|---|---|---|---|---|---|---|---|---|---|---|
| 41 | 98.195 | 0.03 | 1.5 | 0.005 | 0.05 | 0.1 | 0.1 | 0.02 | 5 | 93 | 27 | −21 | −23 |
| 42 | 98.175 | 0.05 | 1.5 | 0.005 | 0.05 | 0.1 | 0.1 | 0.02 | 5 | 110 | 41 | −1 | −1.2 |
| 4 | 97.725 | 0.5 | 1.5 | 0.005 | 0.05 | 0.1 | 0.1 | 0.02 | 5 | 102 | 61 | −0.2 | −0.2 |
| 43 | 96.225 | 2 | 1.5 | 0.005 | 0.05 | 0.1 | 0.1 | 0.02 | 5 | 102 | 56 | −0.4 | −0.4 |
| 44 | 93.225 | 5 | 1.5 | 0.005 | 0.05 | 0.1 | 0.1 | 0.02 | 5 | 104 | 50 | −0.4 | −0.4 |
| 45 | 91.225 | 7 | 1.5 | 0.005 | 0.05 | 0.1 | 0.1 | 0.02 | 5 | 135 | 33 | −23.7 | −26 |
| 46 | 99.175 | 0.5 | 0.05 | 0.005 | 0.05 | 0.1 | 0.1 | 0.02 | 5 | 87 | 25 | −28 | −32 |
| 47 | 99.125 | 0.5 | 0.1 | 0.005 | 0.05 | 0.1 | 0.1 | 0.02 | 5 | 98 | 40 | −1.6 | −1.8 |
| 48 | 99.025 | 0.5 | 0.2 | 0.005 | 0.05 | 0.1 | 0.1 | 0.02 | 5 | 100 | 47 | −0.5 | −0.5 |
| 4 | 97.725 | 0.5 | 1.5 | 0.005 | 0.05 | 0.1 | 0.1 | 0.02 | 5 | 102 | 61 | −0.2 | −0.2 |
| 49 | 84.225 | 0.5 | 15 | 0.005 | 0.05 | 0.1 | 0.1 | 0.02 | 5 | 103 | 52 | −0.2 | −0.2 |
| 50 | 79.225 | 0.5 | 20 | 0.005 | 0.05 | 0.1 | 0.1 | 0.02 | 5 | 107 | 50 | −0.9 | −0.9 |
| 51 | 74.225 | 0.5 | 25 | 0.005 | 0.05 | 0.1 | 0.1 | 0.02 | 5 | 113 | 31 | −15 | −17 |
| 52 | 97.729 | 0.5 | 1.5 | 0.0002 | 0.05 | 0.1 | 0.1 | 0.02 | 5 | 121 | 29 | −18 | −20 |
| 53 | 97.729 | 0.5 | 1.5 | 0.0005 | 0.05 | 0.1 | 0.1 | 0.02 | 5 | 107 | 44 | −0.8 | −0.8 |
| 54 | 97.729 | 0.5 | 1.5 | 0.001 | 0.05 | 0.1 | 0.1 | 0.02 | 5 | 105 | 53 | −0.4 | −0.4 |
| 4 | 97.725 | 0.5 | 1.5 | 0.005 | 0.05 | 0.1 | 0.1 | 0.02 | 5 | 102 | 61 | −0.2 | −0.2 |
| 55 | 97.72 | 0.5 | 1.5 | 0.01 | 0.05 | 0.1 | 0.1 | 0.02 | 5 | 102 | 57 | −0.3 | −0.3 |
| 56 | 97.63 | 0.5 | 1.5 | 0.1 | 0.05 | 0.1 | 0.1 | 0.02 | 5 | 100 | 48 | −0.5 | −0.6 |
| 57 | 97.53 | 0.5 | 1.5 | 0.2 | 0.05 | 0.1 | 0.1 | 0.02 | 5 | 100 | 48 | −0.5 | −0.6 |
| 58 | 97.23 | 0.5 | 1.5 | 0.5 | 0.05 | 0.1 | 0.1 | 0.02 | 5 | 97 | 45 | −0.7 | −0.7 |
| 59 | 96.73 | 0.5 | 1.5 | 1 | 0.05 | 0.1 | 0.1 | 0.02 | 5 | 85 | 25 | −19 | −21 |
| 60 | 97.774 | 0.5 | 1.5 | 0.005 | 0.0005 | 0.1 | 0.1 | 0.02 | 5 | 78 | 33 | −28 | −33 |
| 61 | 97.774 | 0.5 | 1.5 | 0.005 | 0.001 | 0.1 | 0.1 | 0.02 | 5 | 95 | 43 | −1.1 | −1.3 |
| 62 | 97.77 | 0.5 | 1.5 | 0.005 | 0.005 | 0.1 | 0.1 | 0.02 | 5 | 97 | 47 | −0.9 | −1.1 |
| 63 | 97.765 | 0.5 | 1.5 | 0.005 | 0.01 | 0.1 | 0.1 | 0.02 | 5 | 100 | 55 | −0.3 | −0.3 |
| 4 | 97.725 | 0.5 | 1.5 | 0.005 | 0.05 | 0.1 | 0.1 | 0.02 | 5 | 102 | 61 | −0.2 | −0.2 |
| 64 | 97.675 | 0.5 | 1.5 | 0.005 | 0.1 | 0.1 | 0.1 | 0.02 | 5 | 102 | 58 | −0.3 | −0.3 |
| 65 | 96.775 | 0.5 | 1.5 | 0.005 | 1 | 0.1 | 0.1 | 0.02 | 5 | 107 | 50 | −0.3 | −0.3 |
| 66 | 95.775 | 0.5 | 1.5 | 0.005 | 2 | 0.1 | 0.1 | 0.02 | 5 | 110 | 35 | −23 | −25 |
| 67 | 97.82 | 0.5 | 1.5 | 0.005 | 0.05 | 0.005 | 0.1 | 0.02 | 5 | 95 | 27 | −35 | −38 |
| 68 | 97.815 | 0.5 | 1.5 | 0.005 | 0.05 | 0.01 | 0.1 | 0.02 | 5 | 100 | 40 | −1.4 | −1.5 |
| 4 | 97.725 | 0.5 | 1.5 | 0.005 | 0.05 | 0.1 | 0.1 | 0.02 | 5 | 102 | 61 | −0.2 | −0.2 |
| 69 | 96.825 | 0.5 | 1.5 | 0.005 | 0.05 | 1 | 0.1 | 0.02 | 5 | 105 | 49 | −0.5 | −0.5 |
| 70 | 95.825 | 0.5 | 1.5 | 0.005 | 0.05 | 2 | 0.1 | 0.02 | 5 | 112 | 35 | −19 | −22 |

TABLE 5

| Sample | Additive components (atom %) | | | | | | | | | | | Ca/Si | $V_{1mA}$ | | $\Delta V_{1mA}$ Forward | $\Delta V_{1mA}$ Reverse |
|---|---|---|---|---|---|---|---|---|---|---|---|---|---|---|---|---|
| No. | Zn | Pr | Co | Al | B | Ga | In | K | Cr | Ca | Si | ratio | (V) | α | (%) | (%) |
| 71 | 97.73 | 0.5 | 1.5 | 0 | 0.005 | 0 | 0 | 0.05 | 0.1 | 0.1 | 0.02 | 5 | 115 | 68 | −0.2 | −0.3 |
| 72 | 97.73 | 0.5 | 1.5 | 0 | 0 | 0.005 | 0 | 0.05 | 0.1 | 0.1 | 0.02 | 5 | 98 | 41 | −0.2 | −0.2 |
| 73 | 97.73 | 0.5 | 1.5 | 0 | 0 | 0 | 0.005 | 0.05 | 0.1 | 0.1 | 0.02 | 5 | 87 | 37 | −0.3 | −0.3 |
| 74 | 97.727 | 0.5 | 1.5 | 0.0025 | 0.0025 | 0 | 0 | 0.05 | 0.1 | 0.1 | 0.02 | 5 | 108 | 63 | −0.2 | −0.2 |
| 75 | 97.727 | 0.5 | 1.5 | 0.0025 | 0 | 0.0025 | 0 | 0.05 | 0.1 | 0.1 | 0.02 | 5 | 103 | 46 | −0.3 | −0.3 |
| 76 | 97.727 | 0.5 | 1.5 | 0.0025 | 0 | 0 | 0.0025 | 0.05 | 0.1 | 0.1 | 0.02 | 5 | 95 | 41 | −0.2 | −0.3 |
| 77 | 97.73 | 0.5 | 1.5 | 0 | 0.0025 | 0.0025 | 0 | 0.05 | 0.1 | 0.1 | 0.02 | 5 | 104 | 40 | −0.2 | −0.2 |
| 78 | 97.73 | 0.5 | 1.5 | 0 | 0.0025 | 0 | 0.0025 | 0.05 | 0.1 | 0.1 | 0.02 | 5 | 93 | 38 | −0.3 | −0.3 |
| 79 | 97.73 | 0.5 | 1.5 | 0 | 0 | 0.0025 | 0.0025 | 0.05 | 0.1 | 0.1 | 0.02 | 5 | 90 | 38 | −0.2 | −0.3 |
| 80 | 97.728 | 0.5 | 1.5 | 0.002 | 0.002 | 0.002 | 0 | 0.05 | 0.1 | 0.1 | 0.02 | 5 | 96 | 46 | −0.2 | −0.2 |
| 81 | 97.728 | 0.5 | 1.5 | 0.002 | 0 | 0.002 | 0.002 | 0.05 | 0.1 | 0.1 | 0.02 | 5 | 93 | 43 | −0.3 | −0.3 |
| 82 | 97.728 | 0.5 | 1.5 | 0.002 | 0.002 | 0 | 0.002 | 0.05 | 0.1 | 0.1 | 0.02 | 5 | 95 | 47 | −0.2 | −0.3 |
| 83 | 97.73 | 0.5 | 1.5 | 0 | 0.002 | 0.002 | 0.002 | 0.05 | 0.1 | 0.1 | 0.02 | 5 | 93 | 44 | −0.2 | −0.2 |
| 84 | 97.729 | 0.5 | 1.5 | 0.001 | 0.001 | 0.001 | 0.001 | 0.05 | 0.1 | 0.1 | 0.02 | 5 | 86 | 42 | −0.2 | −0.3 |

TABLE 6

| Sample | Additive components (atom %) | | | | | | | | | | Ca/Si | $V_{1mA}$ | | $\Delta V_{1mA}$ | $\Delta V_{1mA}$ |
|---|---|---|---|---|---|---|---|---|---|---|---|---|---|---|---|
| No. | Zn | Pr | Co | Al | K | Rb | Cs | Cr | Ca | Si | ratio | (V) | α | Forward (%) | Reverse (%) |
| 85 | 97.775 | 0.5 | 1.5 | 0.005 | 0 | 0.05 | 0 | 0.1 | 0.1 | 0.02 | 5 | 101 | 59 | −0.3 | −0.3 |
| 86 | 97.775 | 0.5 | 1.5 | 0.005 | 0 | 0 | 0.05 | 0.1 | 0.1 | 0.02 | 5 | 100 | 60 | −0.2 | −0.3 |
| 87 | 97.75 | 0.5 | 1.5 | 0.005 | 0.025 | 0.025 | 0 | 0.1 | 0.1 | 0.02 | 5 | 102 | 62 | −0.2 | −0.2 |
| 88 | 97.75 | 0.5 | 1.5 | 0.005 | 0.025 | 0 | 0.025 | 0.1 | 0.1 | 0.02 | 5 | 102 | 59 | −0.3 | −0.3 |
| 89 | 97.775 | 0.5 | 1.5 | 0.005 | 0 | 0.025 | 0.025 | 0.1 | 0.1 | 0.02 | 5 | 101 | 60 | −0.2 | −0.2 |
| 90 | 97.755 | 0.5 | 1.5 | 0.005 | 0.02 | 0.02 | 0.02 | 0.1 | 0.1 | 0.02 | 5 | 103 | 64 | −0.2 | −0.2 |

EXAMPLE 2

To ZnO powder were added and mixed MgO, $Pr_6O_{11}$, $Co_3O_4$, $CaCO_3$, $SiO_2$, and other additives in amounts corresponding to the atom percents (calculated in percent based on the metal or metalloid elements) shown in Table 7, and the mixtures were granulated with the aid of a binder. In sample Nos. 91 to 97, the amount of silicon (Si) was changed relative to a fixed amount of calcium (Ca). Inversely, in sample Nos. 98 to 104, the amount of Ca was changed relative to a fixed amount of Si. Further in sample Nos. 105 to 109, the amounts of Ca and Si were changed with the Ca/Si ratio fixed at 5.

TABLE 7

| Sample | Additive components (atom %) | | | | | | | | Ca/Si | $V_{1mA}$ | | Leakage current 125° C. | $\Delta V_{1mA}$ | $\Delta V_{1mA}$ |
|---|---|---|---|---|---|---|---|---|---|---|---|---|---|---|
| No. | Pr | Co | Al | K | Cr | Ca | Si | Mg | ratio | (V) | α | (μA) | Forward (%) | Reverse (%) |
| 91 | 0.5 | 1.5 | 0.005 | 0.05 | 0.1 | 0.1 | 0.8 | 5.0 | 0.125 | 211 | 38 | 35 | −20.1 | −23.4 |
| 92 | 0.5 | 1.5 | 0.005 | 0.05 | 0.1 | 0.1 | 0.5 | 5.0 | 0.2 | 205 | 42 | 33 | −1.0 | −1.2 |
| 93 | 0.5 | 1.5 | 0.005 | 0.05 | 0.1 | 0.1 | 0.05 | 5.0 | 2 | 193 | 47 | 21 | −0.5 | −0.5 |
| 94 | 0.5 | 1.5 | 0.005 | 0.05 | 0.1 | 0.1 | 0.02 | 5.0 | 5 | 190 | 58 | 26 | −0.2 | −0.3 |
| 95 | 0.5 | 1.5 | 0.005 | 0.05 | 0.1 | 0.1 | 0.01 | 5.0 | 10 | 186 | 43 | 25 | −1.2 | −1.3 |
| 96 | 0.5 | 1.5 | 0.005 | 0.05 | 0.1 | 0.1 | 0.005 | 5.0 | 20 | 181 | 47 | 42 | −2.8 | −3.1 |
| 97 | 0.5 | 1.5 | 0.005 | 0.05 | 0.1 | 0.1 | 0.0008 | 5.0 | 125 | 177 | 25 | 47 | −25.6 | −38.7 |
| 98 | 0.5 | 1.5 | 0.005 | 0.05 | 0.1 | 0.008 | 0.05 | 5.0 | 0.16 | 172 | 25 | 55 | −12.2 | −20.5 |
| 99 | 0.5 | 1.5 | 0.005 | 0.05 | 0.1 | 0.05 | 0.05 | 5.0 | 1 | 185 | 37 | 40 | −1.3 | −1.4 |
| 100 | 0.5 | 1.5 | 0.005 | 0.05 | 0.1 | 0.1 | 0.05 | 5.0 | 2 | 193 | 47 | 21 | −0.5 | −0.9 |
| 101 | 0.5 | 1.5 | 0.005 | 0.05 | 0.1 | 0.2 | 0.05 | 5.0 | 4 | 197 | 62 | 16 | −0.5 | −0.4 |
| 102 | 0.5 | 1.5 | 0.005 | 0.05 | 0.1 | 0.8 | 0.05 | 5.0 | 16 | 199 | 50 | 16 | −2.1 | −2.8 |
| 103 | 0.5 | 1.5 | 0.005 | 0.05 | 0.1 | 1 | 0.05 | 5.0 | 20 | 202 | 46 | 20 | −4.4 | −4.1 |
| 104 | 0.5 | 1.5 | 0.005 | 0.05 | 0.1 | 3 | 0.05 | 5.0 | 60 | 207 | 35 | 25 | −15.3 | −20.6 |

TABLE 7-continued

| Sample | Additive components (atom %) | | | | | | | | Ca/Si | $V_{1mA}$ | | Leakage current 125° C. | $\Delta V_{1mA}$ | $\Delta V_{1mA}$ |
|---|---|---|---|---|---|---|---|---|---|---|---|---|---|---|
| No. | Pr | Co | Al | K | Cr | Ca | Si | Mg | ratio | (V) | α | (μA) | Forward (%) | Reverse (%) |
| 105 | 0.5 | 1.5 | 0.005 | 0.05 | 0.1 | 0.003 | 0.0006 | 5.0 | 5 | 161 | 21 | 55 | −16.9 | −18.2 |
| 106 | 0.5 | 1.5 | 0.005 | 0.05 | 0.1 | 0.03 | 0.006 | 5.0 | 5 | 184 | 44 | 42 | −0.5 | −0.4 |
| 107 | 0.5 | 1.5 | 0.005 | 0.05 | 0.1 | 0.1 | 0.02 | 5.0 | 5 | 190 | 58 | 26 | −0.2 | −0.3 |
| 108 | 0.5 | 1.5 | 0.005 | 0.05 | 0.1 | 1 | 0.2 | 5.0 | 5 | 204 | 46 | 19 | −3.8 | −4.3 |
| 109 | 0.5 | 1.5 | 0.005 | 0.05 | 0.1 | 3 | 0.6 | 5.0 | 5 | 216 | 42 | 19 | −20.6 | −26.7 |

The mixtures were pressure molded into disks of 12 mm in diameter and 3.2 mm thick, heated at 500° to 800° C. for several hours for binder removal, and fired in air at a temperature of 1,200° to 1,400° C., which is higher than the conventional firing temperature, for several hours into sintered disks. Silver paste was printed to both the surfaces of the sintered disks in a predetermined pattern and baked to form electrodes, completing voltage-dependent nonlinear resistors or sample Nos. 91 to 109, which were measured for electrical properties.

The electrical property measured was a nonlinearity index α between 1 mA and 10 mA and the load life property at high temperature and humidity measured was a change rate of the electrode voltage ($V_{1mA}$) developed when a current flow of 1 mA was conducted after a voltage corresponding to 90% of the varistor voltage was applied for 100 hours in an atmosphere of temperature 85° C. and humidity 85%.

Provided that the current in the same direction as the positive to negative electrode upon voltage application is forward and the current in the opposite direction is reverse, the change rate was measured in both the directions to examine the symmetry of degradation.

Additionally, each sample was measured for leakage current with a voltage corresponding to 90% of the varistor voltage applied at 125° C.

The results are shown in the foregoing Table 7. It is to be noted that the nonlinearity index α is represented by the following equation:

$$\alpha=\log(10/1)/\log(V_{10mA}/V_{1mA})$$

wherein $V_{10mA}$ and $V_{1mA}$ denote varistor voltages at 10 mA and 1 mA, respectively.

It is seen from Table 7 that in sample Nos. 92 to 96 wherein Ca/Si is between 0.2 and 20, the change rate of $V_{1mA}$ is as small as −2.8 at maximum upon forward current conduction and little difference found between the change rates upon forward and reverse current conduction indicates good symmetry.

However, in sample Nos. 91 and 97, the change rate of $V_{1mA}$ is as large as −20.1% and −25.6%, indicating a short life, and the difference between the change rates is as large as 3.3% and 13.1%, indicating low symmetry.

Also, when the amount of Ca is varied, sample Nos. 98 and 104 wherein Ca/Si is outside the range between 0.2 and 20 show a higher change rate and a larger difference between forward and reverse change rates as compared with sample Nos. 99 to 103 wherein Ca/Si is inside the range, indicating asymmetric degradation.

Further, it is seen that even with the value of Ca/Si set optimum 5 among sample Nos. 91 to 109, if the amount of Ca added is less than 0.01 atom % or more than 2 atom % or if the amount of Si added is less than 0.001 atom % or more than 0.5 atom %, that is, for a given value of Ca/Si in the preferred range, if the amount of Ca or Si added is too large or too small, initial properties and reliability are adversely affected.

Next, with the amounts of Ca and Si set at the preferred values of 0.1 atom % and 0.05 atom %, respectively, and the Ca/Si set at the preferred value of 2, sample Nos. 110 to 119 were prepared by the same procedure as above by varying the amount of Mg as shown in Table 8. These samples were also measured for the above-mentioned electrical properties. The results are also shown in Table 8. It is to be noted that a 1:1:1:1 mixture of B, Al, Ga, and In was used as the Group IIIb elements and a 1:1:1 mixture of K, Rb, and Cs was used as the Group Ia elements.

TABLE 8

| Sample | Additive components (atom %) | | | | | | | | | $V_{1mA}$ | | Leakage current 125° C. | $\Delta V_{1mA}$ | $\Delta V_{1mA}$ |
|---|---|---|---|---|---|---|---|---|---|---|---|---|---|---|
| No. | Pr | Co | Group IIIb | Group Ia | Cr | Ca | Si | Mg | Ca/Si | (V) | α | (μA) | Forward (%) | Reverse (%) |
| 110 | 0.5 | 1.5 | 0.005 | 0.05 | 0.1 | 0.1 | 0.05 | 0.02 | 2 | 147.5 | 42 | 152 | −0.3 | −0.3 |
| 111 | 0.5 | 1.5 | 0.005 | 0.05 | 0.1 | 0.1 | 0.05 | 0.05 | 2 | 149 | 44 | 90 | −0.2 | −0.3 |
| 112 | 0.5 | 1.5 | 0.005 | 0.05 | 0.1 | 0.1 | 0.05 | 0.1 | 2 | 149 | 43 | 84 | −0.3 | −0.4 |
| 113 | 0.5 | 1.5 | 0.005 | 0.05 | 0.1 | 0.1 | 0.05 | 0.2 | 2 | 154 | 44 | 84 | −0.3 | −0.2 |
| 114 | 0.5 | 1.5 | 0.005 | 0.05 | 0.1 | 0.1 | 0.05 | 0.5 | 2 | 151 | 39 | 75 | −0.3 | −0.3 |
| 115 | 0.5 | 1.5 | 0.005 | 0.05 | 0.1 | 0.1 | 0.05 | 1.0 | 2 | 159 | 40 | 59 | −0.2 | −0.4 |
| 116 | 0.5 | 1.5 | 0.005 | 0.05 | 0.1 | 0.1 | 0.05 | 2.0 | 2 | 166 | 41 | 34 | −0.5 | −0.5 |
| 117 | 0.5 | 1.5 | 0.005 | 0.05 | 0.1 | 0.1 | 0.05 | 5.0 | 2 | 193 | 47 | 21 | −0.5 | −0.4 |
| 118 | 0.5 | 1.5 | 0.005 | 0.05 | 0.1 | 0.1 | 0.05 | 10.0 | 2 | 262 | 34 | 92 | −2.6 | −3.2 |
| 119 | 0.5 | 1.5 | 0.005 | 0.05 | 0.1 | 0.1 | 0.05 | 15.0 | 2 | 302 | 32 | 316 | −18.7 | −19.0 |

Group IIIb 1:1:1:1 mixture of B, Al, Ga and In
Group Ia 1:1:1 mixture of K, Rb and Cs It is seen from Table 8 that if the amount of Mg deviates from the preferred range of 0.05 to 10 atom % as in sample Nos. 110 and 119, undesirably the leakage current drastically increases. In sample Nos. 110 to 119, the sintered bodies were measured for grain size. Sample Nos. 110 and 119 had a grain size of 11.6 μm and 8.5 μm, respectively, and sample Nos. 111 to 118 had a grain size of 9.0 to 11.7 μm. In sample Nos. 91 to 109 shown in Table 7, the amount of Mg added is fixed at the preferred value of 5.0 atom %.

Next, sample Nos. 120 to 132 were prepared by the same procedure as above by adding rare earth elements other than praseodymium Pr, that is, lanthanum La, neodymium Nd, samarium Sm, europium Eu, gadolinium Gd, terbium Tb, dysprosium Dy, holmium Ho, erbium Er, thulium Tm, ytterbium Yb, and lutetium Lu and other additives to ZnO powder as shown in Table 9. These samples, Nos. 120 to 132, were also measured for electrical properties under the same conditions as above. The results are also shown in Table 9.

TABLE 9

| Sample | Rare | Addition | Additive components (atom %) | | | | | | | | $V_{1mA}$ | | Leakage current 125° C. | $\Delta V_{1mA}$ | $\Delta V_{1mA}$ |
|---|---|---|---|---|---|---|---|---|---|---|---|---|---|---|---|
| No. | earth | amount | Co | Al | K | Cr | Ca | Si | Mg | Ca/Si | (V) | α | (μA) | Forward (%) | Reverse (%) |
| 120 | Pr | 0.5 | 1.5 | 0.005 | 0.05 | 0.1 | 0.1 | 0.05 | 5.0 | 2 | 193 | 47 | 21 | −0.5 | −0.4 |
| 121 | La | 0.5 | 1.5 | 0.005 | 0.05 | 0.1 | 0.1 | 0.05 | 5.0 | 2 | 185 | 42 | 28 | −1.0 | −1.4 |
| 122 | Nd | 0.5 | 1.5 | 0.005 | 0.05 | 0.1 | 0.1 | 0.05 | 5.0 | 2 | 222 | 51 | 24 | −0.6 | −0.6 |
| 123 | Sm | 0.5 | 1.5 | 0.005 | 0.05 | 0.1 | 0.1 | 0.05 | 5.0 | 2 | 218 | 49 | 34 | −1.2 | −1.3 |
| 124 | Eu | 0.5 | 1.5 | 0.005 | 0.05 | 0.1 | 0.1 | 0.05 | 5.0 | 2 | 205 | 57 | 22 | −0.9 | −1.0 |
| 125 | Gd | 0.5 | 1.5 | 0.005 | 0.05 | 0.1 | 0.1 | 0.05 | 5.0 | 2 | 226 | 50 | 21 | −1.5 | −1.5 |
| 126 | Tb | 0.5 | 1.5 | 0.005 | 0.05 | 0.1 | 0.1 | 0.05 | 5.0 | 2 | 209 | 45 | 33 | −2.0 | −2.3 |
| 127 | Dy | 0.5 | 1.5 | 0.005 | 0.05 | 0.1 | 0.1 | 0.05 | 5.0 | 2 | 211 | 54 | 19 | −1.1 | −1.6 |
| 128 | Ho | 0.5 | 1.5 | 0.005 | 0.05 | 0.1 | 0.1 | 0.05 | 5.0 | 2 | 214 | 47 | 27 | −0.9 | −0.8 |
| 129 | Er | 0.5 | 1.5 | 0.005 | 0.05 | 0.1 | 0.1 | 0.05 | 5.0 | 2 | 213 | 46 | 32 | −1.4 | −1.9 |
| 130 | Tm | 0.5 | 1.5 | 0.005 | 0.05 | 0.1 | 0.1 | 0.05 | 5.0 | 2 | 210 | 47 | 27 | −1.3 | −1.3 |
| 131 | Yb | 0.5 | 1.5 | 0.005 | 0.05 | 0.1 | 0.1 | 0.05 | 5.0 | 2 | 211 | 48 | 20 | −1.4 | −1.7 |
| 132 | Lu | 0.5 | 1.5 | 0.005 | 0.05 | 0.1 | 0.1 | 0.05 | 5.0 | 2 | 223 | 43 | 21 | −2.3 | −2.7 |

As seen from Table 9, the addition of rare earth elements other than Pr gave satisfactory results in the high temperature/high humidity load test like the addition of Pr. Similar tests were done with rare earth elements other than the above-mentioned ones, obtaining equivalent results.

Table 10 shows examples wherein the amounts of additives were varied with the Ca/Si ratio fixed.

TABLE 10

| Sample | Additive components (atom %) | | | | | | | | | Ca/Si | $V_{1mA}$ | | Leakage current 125° C. | $\Delta V_{1mA}$ Forward | $\Delta V_{1mA}$ Reverse |
|---|---|---|---|---|---|---|---|---|---|---|---|---|---|---|---|
| No. | Zn | Pr | Co | Al | K | Cr | Ca | Si | Mg | ratio | (V) | α | (μA) | (%) | (%) |
| 133 | 98.195 | 0.03 | 1.5 | 0.005 | 0.05 | 0.1 | 0.1 | 0.02 | 5 | 5 | 171 | 29 | 61 | −25 | −28 |
| 134 | 98.175 | 0.05 | 1.5 | 0.005 | 0.05 | 0.1 | 0.1 | 0.02 | 5 | 5 | 185 | 43 | 30 | −1.2 | −1.4 |
| 135 | 97.725 | 0.5 | 1.5 | 0.005 | 0.05 | 0.1 | 0.1 | 0.02 | 5 | 5 | 190 | 58 | 26 | −0.2 | −0.3 |
| 136 | 96.225 | 2 | 1.5 | 0.005 | 0.05 | 0.1 | 0.1 | 0.02 | 5 | 5 | 193 | 55 | 28 | −0.6 | −0.7 |
| 137 | 93.225 | 5 | 1.5 | 0.005 | 0.05 | 0.1 | 0.1 | 0.02 | 5 | 5 | 223 | 41 | 31 | −0.6 | −0.8 |
| 138 | 91.225 | 7 | 1.5 | 0.005 | 0.05 | 0.1 | 0.1 | 0.02 | 5 | 5 | 255 | 34 | 55 | −28 | −33 |
| 139 | 99.175 | 0.5 | 0.05 | 0.005 | 0.05 | 0.1 | 0.1 | 0.02 | 5 | 5 | 168 | 22 | 60 | −18 | −24 |
| 140 | 99.125 | 0.5 | 0.1 | 0.005 | 0.05 | 0.1 | 0.1 | 0.02 | 5 | 5 | 183 | 37 | 42 | −1.6 | −1.8 |
| 141 | 99.025 | 0.5 | 0.2 | 0.005 | 0.05 | 0.1 | 0.1 | 0.02 | 5 | 5 | 185 | 45 | 37 | −1 | −1.1 |
| 142 | 97.725 | 0.5 | 1.5 | 0.005 | 0.05 | 0.1 | 0.1 | 0.02 | 5 | 5 | 190 | 58 | 26 | −0.2 | −0.3 |
| 143 | 84.225 | 0.5 | 15 | 0.005 | 0.05 | 0.1 | 0.1 | 0.02 | 5 | 5 | 202 | 50 | 30 | −0.3 | −0.3 |
| 144 | 79.225 | 0.5 | 20 | 0.005 | 0.05 | 0.1 | 0.1 | 0.02 | 5 | 5 | 215 | 36 | 44 | −1.5 | −1.7 |
| 145 | 74.225 | 0.5 | 25 | 0.005 | 0.05 | 0.1 | 0.1 | 0.02 | 5 | 5 | 260 | 25 | 65 | −23 | −27 |
| 146 | 97.729 | 0.5 | 1.5 | 0.0002 | 0.05 | 0.1 | 0.1 | 0.02 | 5 | 5 | 247 | 28 | 60 | −27 | −36 |
| 147 | 97.729 | 0.5 | 1.5 | 0.0005 | 0.05 | 0.1 | 0.1 | 0.02 | 5 | 5 | 218 | 46 | 30 | −0.9 | −1.1 |

TABLE 10-continued

| Sample | Additive components (atom %) | | | | | | | | | Ca/Si | $V_{1mA}$ | | Leakage current 125° C. | $\Delta V_{1mA}$ Forward | $\Delta V_{1mA}$ Reverse |
|---|---|---|---|---|---|---|---|---|---|---|---|---|---|---|---|
| No. | Zn | Pr | Co | Al | K | Cr | Ca | Si | Mg | ratio | (V) | α | (μA) | (%) | (%) |
| 148 | 97.729 | 0.5 | 1.5 | 0.001 | 0.05 | 0.1 | 0.1 | 0.02 | 5 | 5 | 197 | 52 | 28 | −0.6 | −0.7 |
| 149 | 97.725 | 0.5 | 1.5 | 0.005 | 0.05 | 0.1 | 0.1 | 0.02 | 5 | 5 | 190 | 58 | 26 | −0.2 | −0.3 |
| 150 | 97.72 | 0.5 | 1.5 | 0.01 | 0.05 | 0.1 | 0.1 | 0.02 | 5 | 5 | 189 | 47 | 31 | −0.3 | −0.5 |
| 151 | 97.63 | 0.5 | 1.5 | 0.1 | 0.05 | 0.1 | 0.1 | 0.02 | 5 | 5 | 185 | 44 | 37 | −0.6 | −0.7 |
| 152 | 97.53 | 0.5 | 1.5 | 0.2 | 0.05 | 0.1 | 0.1 | 0.02 | 5 | 5 | 191 | 37 | 44 | −0.9 | −1.1 |
| 153 | 97.23 | 0.5 | 1.5 | 0.5 | 0.05 | 0.1 | 0.1 | 0.02 | 5 | 5 | 193 | 35 | 44 | −1.1 | −1.4 |
| 154 | 96.73 | 0.5 | 1.5 | 1 | 0.05 | 0.1 | 0.1 | 0.02 | 5 | 5 | 170 | 26 | 65 | −17 | −26 |
| 155 | 97.774 | 0.5 | 1.5 | 0.005 | 0.0005 | 0.1 | 0.1 | 0.02 | 5 | 5 | 177 | 29 | 62 | −15 | −18 |
| 156 | 97.774 | 0.5 | 1.5 | 0.005 | 0.001 | 0.1 | 0.1 | 0.02 | 5 | 5 | 183 | 41 | 40 | −1.9 | −2 |
| 157 | 97.77 | 0.5 | 1.5 | 0.005 | 0.005 | 0.1 | 0.1 | 0.02 | 5 | 5 | 188 | 44 | 37 | −0.5 | −0.5 |
| 158 | 97.765 | 0.5 | 1.5 | 0.005 | 0.01 | 0.1 | 0.1 | 0.02 | 5 | 5 | 187 | 51 | 29 | −0.2 | −0.2 |
| 159 | 97.725 | 0.5 | 1.5 | 0.005 | 0.05 | 0.1 | 0.1 | 0.02 | 5 | 5 | 190 | 58 | 26 | −0.2 | −0.3 |
| 160 | 96.775 | 0.5 | 1.5 | 0.005 | 1 | 0.1 | 0.1 | 0.02 | 5 | 5 | 195 | 40 | 33 | −0.3 | −0.3 |
| 161 | 95.775 | 0.5 | 1.5 | 0.005 | 2 | 0.1 | 0.1 | 0.02 | 5 | 5 | 232 | 31 | 59 | −0.3 | −0.4 |
| 162 | 97.82 | 0.5 | 1.5 | 0.005 | 0.05 | 0.005 | 0.1 | 0.02 | 5 | 5 | 181 | 25 | 55 | −13 | −18 |
| 163 | 97.815 | 0.5 | 1.5 | 0.005 | 0.05 | 0.01 | 0.1 | 0.02 | 5 | 5 | 185 | 40 | 36 | −1.4 | −1.8 |
| 164 | 97.725 | 0.5 | 1.5 | 0.005 | 0.05 | 0.1 | 0.1 | 0.02 | 5 | 5 | 190 | 58 | 26 | −0.2 | −0.3 |
| 165 | 96.825 | 0.5 | 1.5 | 0.005 | 0.05 | 1 | 0.1 | 0.02 | 5 | 5 | 197 | 48 | 28 | −0.7 | −0.8 |
| 166 | 95.825 | 0.5 | 1.5 | 0.005 | 0.05 | 2 | 0.1 | 0.02 | 5 | 5 | 244 | 25 | 67 | −22 | −29 |

EXAMPLE 3

A powder sample having the same composition as sample No. 4 was wet mixed, dried, granulated, and pressure molded into cylindrical compacts of 12 mm in diameter and 1.6 mm thick.

Thereafter, the compacts were fired according to the schedule shown in FIG. 1 to give sample Nos. 201 to 214, according to the schedule shown in FIG. 2 to give sample Nos. 215 to 219, and according to the schedule shown in FIG. 3 to give sample Nos. 220 to 224. The fired samples were of a shape having a diameter of about 10 mm and a thickness of about 1.4 mm. The holding temperature of the temperature holding step in the firing process was 1,300° C. and the holding time was 4 hours. The holding temperature of the temperature holding step in the pretreatment process was 1,200° C. and the holding time was 1 hour. The temperature rise and drop rates were 200° C./hour in all cases. With respect to the oxygen partial pressure, the first oxygen partial pressure was 0 atm (only $N_2$) atmosphere, $1\times10^{-2}$ atm ($N_2$-1%$O_2$) atmosphere, and $1\times10^{-1}$ atm ($N_2$-10%$O_2$) atmosphere, and the second oxygen partial pressure was $2\times10^{-1}$ atm atmosphere (ambient air), $5\times10^{-1}$ atm ($N_2$-50%$O_2$) atmosphere, and 1 atm (only $O_2$) atmosphere. A switch therebetween was done at the point of time shown in Table 11.

Equivalent results were found in various compositions within the scope of the invention including MgO-containing sample No. 94. Equivalent results were also found with 98.3 mol % of ZnO, 0.5 mol % of $Pr_6O_{11}$, 1.0 mol % of CoO, 0.1 mol % of $Cr_2O_3$, and 0.1 mol % of CaO.

TABLE 11

| Sample No. | Atmosphere switching | Switch point | Before switch | After switch | Surge life | Standard deviation |
|---|---|---|---|---|---|---|
| 201 | Intermediate point during high tempreature holding | 1300° C. | 0 | 0.2 | −4 | 4.5 |
| 202 | Temperature rise | 1300° C. | 0 | 0.2 | −1 | 0.8 |
| 203 | Temperature rise | 1200° C. | 0 | 0.2 | −0.6 | 0.4 |
| 204 | Temperature rise | 1100° C. | 0 | 0.2 | −0.6 | 0.5 |
| 205 | Temperature rise | 1000° C. | 0 | 0.2 | −0.6 | 0.6 |
| 206 | Temperature rise | 800° C. | 0 | 0.2 | −0.7 | 1.7 |
| 207 | Temperature rise | 600° C. | 0 | 0.2 | −1 | 2.5 |
| 208 | Temperature rise | 400° C. | 0 | 0.2 | −3.5 | 4.8 |
| 209 | Temperature rise | 1200° C. | 0.01 | 0.2 | −0.7 | 0.6 |
| 210 | Temperature rise | 1200° C. | 0.1 | 0.2 | −0.8 | 0.8 |
| 211 | Temperature rise | 1200° C. | 0.2 | 0.2 | −12.5 | 14.3 |
| 212 | Temperature rise | 1200° C. | 0 | 0.1 | −25 | 35.4 |
| 213 | Temperature rise | 1200° C. | 0 | 0.5 | −0.6 | 0.4 |
| 214 | Temperature rise | 1200° C. | 0 | 1 | −0.4 | 0.3 |
| 215 | First stage | 1300° C. | 0 | 0.2 | −6.3 | 9.2 |
| 216 | First stage | 1200° C. | 0 | 0.2 | −0.7 | 0.5 |
| 217 | First stage | 1000° C. | 0 | 0.2 | −0.6 | 0.6 |
| 218 | First stage | 600° C. | 0 | 0.2 | −1 | 2.7 |
| 219 | First stage | 400° C. | 0 | 0.2 | −11.7 | 18 |
| 220 | Pretreatment | 1300° C. | 0 | 0.2 | −5.9 | 8.1 |
| 221 | Pretreatment | 1200° C. | 0 | 0.2 | −0.8 | 0.7 |
| 222 | Pretreatment | 1000° C. | 0 | 0.2 | −0.8 | 1.2 |
| 223 | Pretreatment | 600° C. | 0 | 0.2 | −1.1 | 2.8 |
| 224 | Pretreatment | 400° C. | 0 | 0.2 | −12.9 | −17.6 |

Electrodes were attached to the above samples, which were measured for surge life property. This measurement was done by measuring a change rate of varistor voltage after a rated surge current flow of 2,500 A was conducted 10 cycles. The results are shown in the foregoing Table 11.

It is seen from Table 11 that sample No. 201 representative of a prior art example had a change rate of −4.0% whereas the samples of the examples falling within the scope of the invention had a change rate of −3.5% at the worst and −0.4% at the best.

It is thus evident that the invention is effective for improving surge life property.

We claim:

1. A voltage-dependent nonlinear resistor in a form of a sintered body comprising a mixture of oxides of metal and metalloid elements as follows:

zinc oxide as a major component and at least one rare earth element oxide, cobalt oxide, chromium oxide, at least one Group IIIb element oxide, at least one Group Ia element oxide, 0.01 to 2 atom % calculated as Ca of calcium oxide, and 0.001 to 0.5 atom % calculated as Si of silicon oxide as subordinate components, the atom % being based on the total amount of metal and metalloid elements, wherein calcium and silicon are present in an atomic ratio of calcium to silicon (Ca/Si) ranging from 0.2 to 20.

2. The voltage-dependent nonlinear resistor of claim 1 wherein said at least one rare earth element is selected from the group consisting of La, Pr, Nd, Sm, Eu, Gd, Tb, Dy, Ho, Er, Tm, Yb, and Lu.

3. The voltage-dependent nonlinear resistor of claims 1 or 2 wherein said at least one Group IIIb element is selected from the group consisting of B, Al, Ga, and In.

4. The voltage-dependent nonlinear resistor of claim 1 wherein said at least one Group Ia element is selected from the group consisting of K, Rb, and Cs.

5. The voltage-dependent nonlinear resistor of claim 1 wherein said atomic ratio of calcium to silicon ranges from 2 to 6.

6. The voltage-dependent nonlinear resistor of claim 1 wherein said at least one rare earth element is present in an amount of 0.05 to 5 atom % based on the total amount of metal and metalloid elements.

7. The voltage-dependent nonlinear resistor of claim 1 wherein cobalt is present in an amount of 0.1 to 20 atom % based on the total amount of metal and metalloid elements.

8. The voltage-dependent nonlinear resistor of claim 1 wherein chromium is present in an amount of 0.01 to 1 atom % based on the total amount of metal and metalloid elements.

9. The voltage-dependent nonlinear resistor of claim 1 wherein said at least one Group IIIb element is present in a total amount of 0.0005 to 0.5 atom % based on the total amount of metal and metalloid elements.

10. The voltage-dependent nonlinear resistor of claim 1 wherein said at least one Group Ia element is present in a total amount of 0.001 to 1 atom % based on the total amount of metal and metalloid elements.

11. The voltage-dependent nonlinear resistor of claim 1 which further contains magnesium oxide.

12. The voltage-dependent nonlinear resistor of claim 11 wherein magnesium is present in an amount of 0.05 to 10 atom % based on the total amount of metal and metalloid elements.

13. The voltage-dependent nonlinear resistor of claim 1 which is prepared by firing a compact of a voltage-dependent nonlinear resistor-forming source powder containing ZnO as a major component according to a firing process including a heating temperature rise step, a high temperature holding step, and a cooling step, wherein the firing atmosphere has an oxygen partial pressure which is kept below $1.5\times10^{-1}$ atm for at least a portion of the heating temperature rise step and thereafter increased above $1.5\times10^{-1}$ atm.

14. The voltage-dependent nonlinear resistor of claim 13 wherein the oxygen partial pressure of the firing atmosphere is switched from below to above $1.5\times10^{-1}$ atm in said heating temperature rise step while the temperature is 600° C. to 1,300° C.

15. The voltage-dependent nonlinear resistor of claim 14 wherein the oxygen partial pressure of the firing atmosphere is switched from below to above $1.5\times10^{-1}$ atm in said heating temperature rise step while the temperature is 800° C. to 1,200° C.

16. The voltage-dependent nonlinear resistor of claim 1 which is prepared by firing a compact of a voltage-dependent nonlinear resistor-forming source powder containing ZnO as a major component according to a firing process including a heating temperature rise step, a high temperature holding step, and a cooling step, wherein said heating temperature rise step includes a temperature holding step inserted midway thereof, and the firing atmosphere has an oxygen partial pressure which is kept below $1.5\times10^{-1}$ atm for at least said temperature holding step and thereafter increased above $1.5\times10^{-1}$ atm.

17. The voltage-dependent nonlinear resistor of claim 16 wherein said temperature holding step is inserted in the temperature range of 600° C. to 1,250° C.

18. The voltage-dependent nonlinear resistor of claim 1 which is prepared by firing a compact of a voltage-dependent nonlinear resistor-forming source powder containing ZnO as a major component according to a firing process including a heating temperature rise step, a high temperature holding step, and a cooling step, wherein a pretreatment process including a heating temperature rise step, a temperature holding step of holding at a treating temperature below the firing temperature, and a cooling step wherein the treating atmosphere has an oxygen partial pressure set below $1.5\times10^{-1}$ atm is provided prior to said firing process, and the oxygen partial pressure of the firing atmosphere is increased above $1.5\times10^{-1}$ atm in said firing process.

19. The voltage-dependent nonlinear resistor of claim 18 wherein said temperature holding step is inserted in the temperature range of 600° C. to 1,250° C.

* * * * *